United States Patent [19]

Uchida et al.

[11] Patent Number: 4,674,940

[45] Date of Patent: Jun. 23, 1987

[54] PACKAGE STORAGE SYSTEM

[75] Inventors: Hiroshi Uchida, Oumihachiman; Shuichi Kikuchi, Shiga, both of Japan

[73] Assignee: Murata Kikai Kabushiki Kaisha, Kyoto, Japan

[21] Appl. No.: 787,744

[22] Filed: Oct. 15, 1985

[30] Foreign Application Priority Data

Oct. 16, 1984 [JP] Japan ..... 59-218055

[51] Int. Cl.[4] ..... B65G 67/00

[52] U.S. Cl. ..... 414/400; 198/368; 198/464.2; 242/35.5 A; 414/748

[58] Field of Search ..... 414/395–398, 414/400, 401, 331, 267, 268, 280, 745, 748, 38–40, 44, 57, 68, 111, 911; 193/27; 211/59.2; 221/242, 281, 295; 198/368, 358, 437, 633, 347, 364, 372, 464.2; 242/35.5 A

[56] References Cited

U.S. PATENT DOCUMENTS

| | | | |
|---|---|---|---|
| 2,146,533 | 2/1939 | Erickson | 193/27 X |
| 2,498,061 | 2/1950 | Apgar | 198/633 X |
| 3,141,537 | 7/1964 | Dillaba | 193/27 |
| 3,301,380 | 1/1967 | Schickle | 198/437 X |
| 3,337,021 | 8/1967 | Stewart | 198/347 |
| 3,385,456 | 5/1968 | Snider | 414/57 X |
| 3,637,095 | 1/1972 | Kampfer | 414/331 |
| 3,836,022 | 9/1974 | Ims | 414/398 |
| 4,227,848 | 10/1980 | Kriechbaum et al. | 414/395 |

*Primary Examiner*—Joseph E. Valenza
*Assistant Examiner*—David A. Bucci
*Attorney, Agent, or Firm*—Spensley Horn Jubas & Lubitz

[57] ABSTRACT

A package storage system comprises a package conveyor disposed next to the package conveyor of the associated winder, a package stocker beside the former package conveyor, and a package transferring mechanism which includes a package positioning device for positioning the package at transfer position and a package transferring device for transferring the package to the stocker.

9 Claims, 9 Drawing Figures

PACKAGE STORAGE SYSTEM

FIELD OF THE INVENTION AND RELATED ART STATEMENT

The present invention relates to a package storage system for storing full packages wound on an automatic winder.

In an automatic winder for rewinding the yarns of cops produced on fine spinning frames in packages each having preselected weight and shape, a plurality of winding units are arranged side by side, a full package wound in each winding unit is doffed from the winding unit by a doffing device, and then the full package is conveyed to one end of the automatic winder by a package conveyor which conveys the full package along the longitudinal direction of the automatic winder. At the end of the automatic winder, the full packages are picked up one by one and packed in a box by the operator or each full package is hung on a hanger which travels along an overhead rail and is transported to a package storeroom.

In the former case, since the packages are doffed unsequentially at different time, the operator is required to be continuously waiting at the end of the winder or is required to pay attention as to whether or not any package is doffed, even while working away from the end of the winder, which is extremely troublesome. In the latter case, a very wide space is necessary for temporarily storing the packages hung on the hangers, respectively, in the package storeroom.

OBJECT AND SUMMARY OF THE INVENTION

It is an object of the present invention to provide a package storage system capable of regularly storing full packages which are doffed unsequentially at different time and position from a winder and conveyed unsequentially to one end of the winder, in a package storage box one by one.

A package storage system according to the present invention comprises a package conveyor disposed next to the package conveyor of the associated winder, a package stocker disposed beside the former package conveyor, and a package transferring mechanism for transferring packages from a fixed position on the former package conveyor into the package stocker.

Packages conveyed by the package conveyor to fixed positions, respectively, are transferred automatically into the package stocker disposed nearby the package conveyor by the package transferring mechanism.

Figure 1:
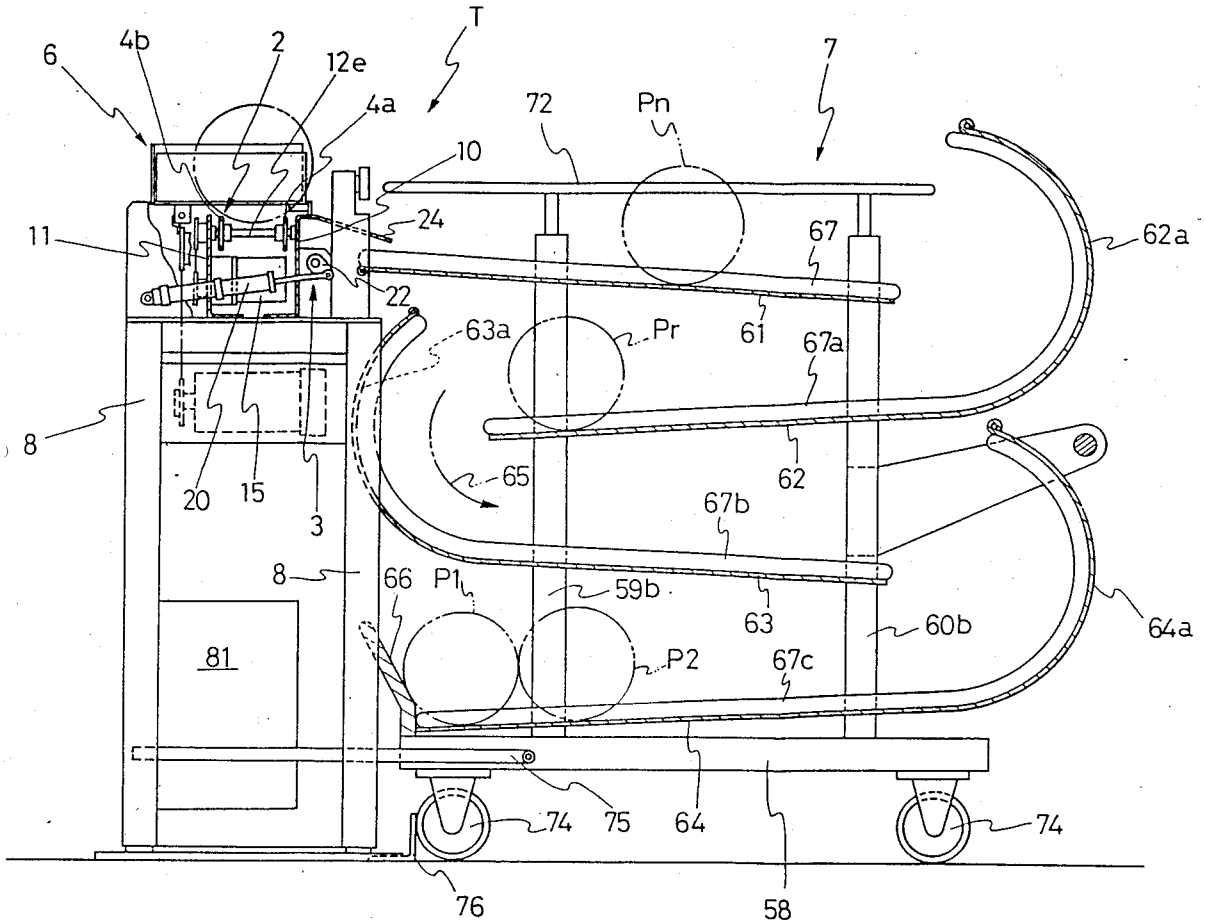
FIG. 1 is a sectional side elevation of a package storage system, in a preferred embodiment, according to the present invention.

FIGS. *7a*, *7b* and *7c* are schematic views of assistance in explaining the manner of operation of the package storage system of FIG. 1.

DETAILED DESCRIPTION OF PREFFERRED EMBODIMENTS

A preferred embodiment of the present invention will be described hereinafter in conjunction with the accompanying drawings.

Figure 2:
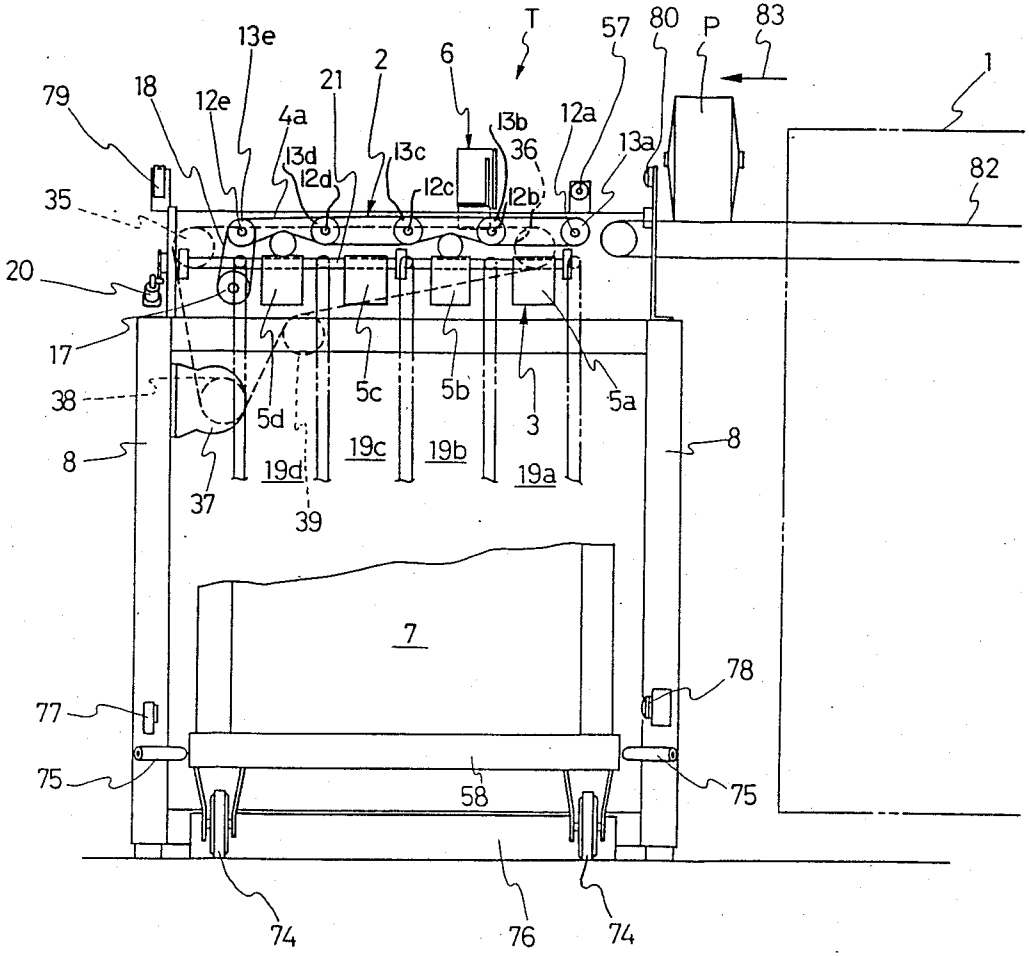
FIG. 2 is a front elevation of the package storage system of FIG. 1.

Referring to FIGS. 1 and 2, a package storage system T is provided at one end of an automatic winder 1 next to the package conveyor of the latter.

The package storage system T comprises a package conveyor 2 disposed at a fixed position relative to the winder, a package transferring mechanism 3 also disposed at a fixed position relative to the winder and a movable stocker located nearby the package conveyor.

In this embodiment, the package conveyor 2 is of the round belt type having two parallel round belts 4*a* and 4*b* spaced apart from each other by a fixed distance; the package transferring mechanism 3 includes pushing plates 5*a* to 5*d* for pushing out packages arrived at fixed positions corresponding to the pushing plates, respectively, in a direction perpendicular to the conveying direction of the package conveyor and a package positioning mechanism 6 for positioning a package for transfer from the package conveyor to the package stocker; and the package stocker 7 for storing the packages transferred thereto has zigzag passages along which the packages roll down so as to be stored in the package stocker 7 as illustrated in FIG. 1.

Figure 3:
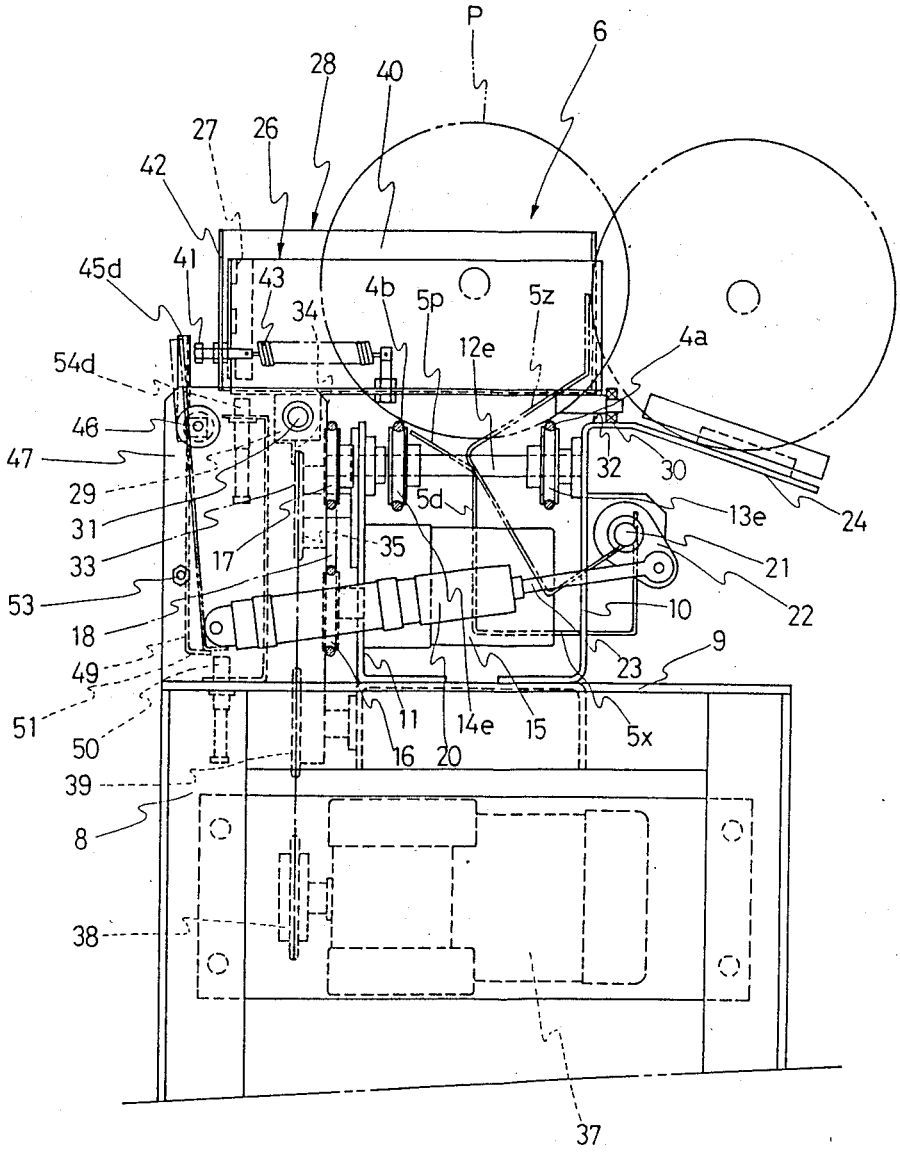
FIG. 3 is a side elevation of a package transferring mechanism employed in the package storage system of FIG. 1.

The respective constitutions of the mechanisms will be described more specifically hereinafter. Referring to FIGS. 1 to 3, the package conveyor 2 mounted on a frame 8 fixedly installed beside the automatic winder comprises endless round belts 4*a* and 4*b* extended between pulleys 13*a* to 13*e* and pulleys 14*a* to 14*e* fixed to the opposite ends of shafts 12*a* to 12*e* arranged at fixed intervals and supported on two opposite brackets 10 and 11 having the shape of an elongate plate fixed to a frame 9, respectively, and a driving motor 15. As illustrated in FIG. 3, the pulleys 13*e* and 14*e* engaging the round belts 4*a* and 4*b*, respectively, are driven by a belt 18 extended between a driving pulley 16 fixed to the output shaft of the motor 15 mounted on the bracket 11 and a driven pulley 17 fixed to one end of the shaft 12*e*. As illustrated in FIG. 2, the shafts 12*a* to 12*e* are disposed in appropriate relation to the package passages 19*a* to 19*d* of the stocker 7 and the pushing plates 5*a* to 5*d*. That is, the shafts 12*a* to 12*e* are disposed so that the shafts 12*a* to 12*e* will not interfere with the turning motion of the pushing plates 5*a* to 5*d* disposed opposite the package passages 19*a* to 19*d*, respectively, namely, the shafts 12*a* to 12*e* are disposed between the adjacent pushing plates 5*a* and 5*b*, 5*b* and 5*c*, and 5*c* and 5*d*, and outside the pushing plates 5*a* and 5*d*.

The package transferring mechanism 3 for transferring a package conveyed by the package conveyor having the round belts 4*a* and 4*b* to a fixed position to the stocker, includes the individual pushing plates 5*a* to 5*d* and a driving source, such as a hydraulic cylinder 20. In this embodiment, the package stocker 7 has four rows of package passages, and hence four pushing plates 5*a* to 5*d* are disposed at four positions. Referring to FIGS. 2 and 3, the pushing plates 5*a* to 5*d* are fixed to a shaft 21 extending over the entire package conveying length of the package conveyor having the round belts 4a and 4b, at positions corresponding to package transferring positions, respectively. A lever 22 is fixed to one end of the shaft 21. The piston rod 23 of the hydraulic cylinder 20 pivotally supported on the frame is connected to the lever 22. As viewed in FIG. 3, the shaft 21 is turned clockwise as the piston rod 23 is retracted. When the shaft 21 is thus turned, all the pushing plates 5a to 5d are turned simultaneously together with the shaft 21. The upper portion of each one of the pushing plates 5a to 5d projects above the round belts 4a and 4b as the same is turned to push a package P carried on the round belts 4a and 4b so that the package P is transferred across the round belt 4a to the stocker. As illustrated in FIG. 3, each pushing plate 5 is formed by bending a flat plate, has a pushing surface 5P and an escape section 5X for avoiding the interference of the pushing plate 5 with the adjacent components of the system, and the pushing plate 5 is swingable between a waiting position 5 indicated by continuous lines and a transfer position 5Z.

Figure 6:
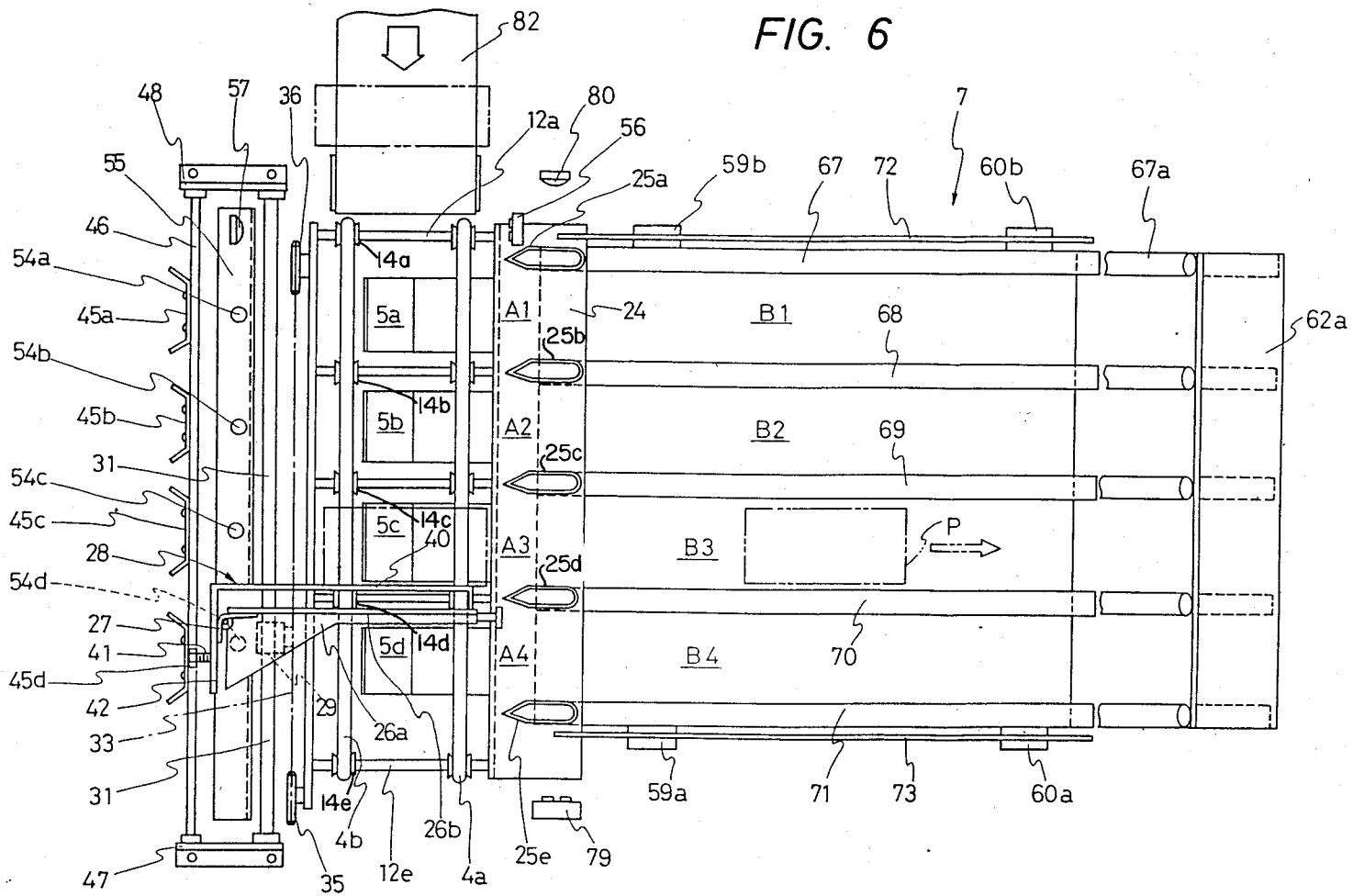
FIG. 6 is a plan view of the package storage system of FIG. 1.

A guide plate 24 is formed integrally with the bracket 10 on the transfer side of the package conveyor. As illustrated in FIG. 6, partition members 25a to 25e for defining the package passages are fixed at regular intervals to the upper surface of the guide plate 24.

The package positioning mechanism 6 for positioning the packages conveyed by the package conveyor 2 at transfer positions will be described hereinafter.

Figure 4:
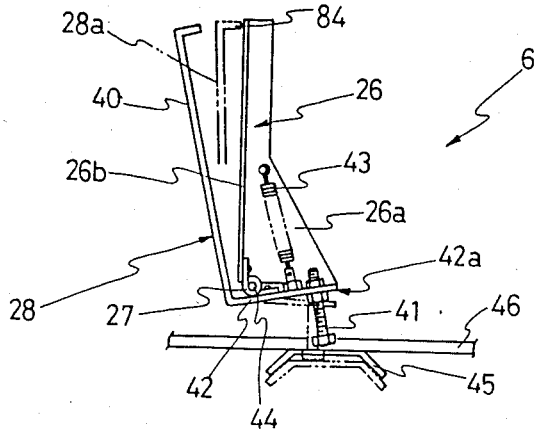
FIG. 4 is a plan view of a package positioning mechanism employed in the package storage system of FIG. 1.

Referring to FIGS. 3, 4 and 6, the package positioning mechanism 6 includes a supporting member 26 capable of only moving along the package conveyor 2, and a package sensing plate 28 joined to the supporting member 26 with a hinge 27 so as to be swingable on the supporting member 26. The package positioning mechanism 6 is movable along the package conveyor 2. As illustrated in FIGS. 3 and 6, the supporting member 26 is formed by integrally joining a bottom plate 26a and a vertical plate 26b having a flat surface extending perpendicularly to the package conveying direction together in an L-shape, a slider 29 and a roller 30 are fixed to the opposite ends of the lower surface of the bottom plate 26a. The slider 29 is supported on a slide shaft 31 extended in parallel to the package conveyor 2 so as to be slidable along the slide shaft 31. The roller 30 is in contact with a guide surface 32 formed in the upper surface of the bracket 10. The slider 29 is joined through a connecting member 34 to a chain 33. Thus, the supporting member 26 is moved along the package conveyor 2 as the chain 33 is rotated. As illustrated in FIGS. 2 and 3, the chain 33 is extended through a tightening sprocket 39 between sprockets 35 and 36 and a driving sprocket 38 fixed to the output shaft of a driving motor 37. The motor 37 is rotatable in opposite directions to move the supporting member 26 either rightward or leftward as viewed in FIG. 2. Preferably, the motor 37 is a motor with a brake.

Figure 5:
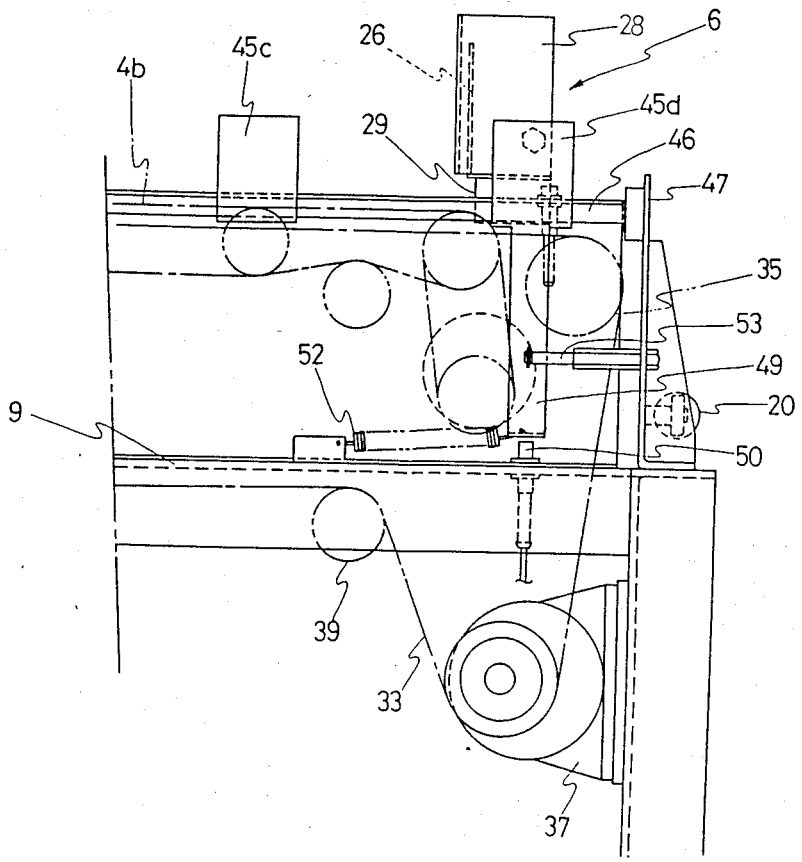
FIG. 5 is a rear view showing the relative configuration of a package sensing plate, a feeler and a proximity switch employed in the package storage system of FIG. 1.

The package sensing plate 28 is joined to one end of the vertical plate 26b with the hinge 27. As illustrated in FIGS. 4 and 6, the package sensing plate 28 is a substantially L-shaped plate as viewed in FIG. 6 and has a package pushing surface 40 and a supporting surface 42 supporting a package sensing dog 41. A spring 43 is extended between the supporting surface 42 and the supporting member 26 to urge the package sensing plate 28 counterclockwise as viewed in FIG. 4 on a pivot 44 so that the package sensing plate 28 is positioned at a position indicated by continuous lines with the end 42a of the supporting surface 42 in abutment with the bottom plate 26a of the supporting member. The dog 41 projecting from the supporting surface is a bolt. The projection of the dog 41 from the supporting surface is adjustable. The dog 41 actuates feelers 45a to 45d disposed so as to correspond to the dog 41. As illustrated in FIGS. 3 and 6, the feelers 45a to 45d are fixed to a rod 46 extended in parallel to the package conveyor 2 so as to correspond to package transferring positions, respectively. The rod 46 is supported at the opposite ends thereof on brackets 47 and 48. When the package sensing plate 28 is actuated and thereby the dog 41 pushes any one of the feelers 45a to 45d, the rod 46 is turned. Consequently, an actuating arm 49 fixed to the rod 46 actuates a proximity switch 50. In this embodiment, the actuating arm 49 is formed integrally with the feeler 45d among the feelers. As illustrated in FIG. 5, a portion of the feeler 45d is extended downward to form the actuating arm 49. As illustrated in FIG. 3, the lower end of the actuating arm 49 is bent to form an acting surface 51 for actuating the proximity switch 50. As illustrated in FIG. 5, a spring 52 is extended between the actuating arm 49 and the frame 9 so as to urge the actuating arm 49 away from the proximity switch 50. Indicated at 53 is a positioning stopper for positioning the actuating arm 49. The actuating arm 49 and the proximity switch 50 may be associated with the feelers of FIG. 6; and the individual feelers 45a to 45d may be substituted by a single continuous plate member. The mechanism including the actuating arm 49, the proximity switch 50 and other associated components is shown as an example of mechanical means for detecting the arrival of the package at the package transferring position. Accordingly, the arrival of the package at the package transferring position may be detected, for example, with a limit switch directly attached to the vertical plate 26b of the supporting member 26 at a position where the vertical plate 26b comes into contact with the package and adapted to be actuates when the brought into contact with the package or with a contactless package detector including photoelectric sensors disposed at the package transferring positions, instead of the mechanism including the sensing plate 28, the feelers 45a to 45d and the proximity switch 50.

As illustrated in FIGS. 3 and 6, proximity sensors 54a to 54d are disposed below the bottom plate 26a of the supporting member 26 to position the package positioning mechanism 6 at the package transferring positions, respectively. The proximity sensors 54a to 54d are disposed on a bracket 55 at positions corresponding to the package transferring positions, respectively. In operation, when only one of the proximity sensors, for example, only the proximity sensor 54d in the state shown in FIG. 6, is set capable of functioning and the other proximity sensors 54a to 54c are set incapable of functioning, namely, incapable of detecting the bottom plate 26a, the motor 37 is stopped upon the arrival of the bottom plate 26a of the supporting member moved by the chain 33 at a position corresponding to the proximity sensor 54d to stop the package positioning mechanism 6 opposite to the proximity sensor 54d and fixed at the same position with the brake of the motor 37 so that the supporting member will not be moved when the package sensing plate 28 is pushed by the package.

In FIG. 6, a package detecting head consists of a projector receiver 56 and a reflecting plate 57. Upon the detection of a package the package conveyor of the automatic winder is stopped, and thereby the simultaneous existence of a plurality of packages on the package conveyor 2 is prevented.

The stocker 7 for storing the packages transferred thereto from the package conveyor 2 will be described hereinafter.

Referring to FIGS. 1 and 6, the stocker 7 regularly and automatically stores the packages transferred thereto from the package conveyor 2. Guide plates 61, 62, 63, and 64 and fixed to posts 59*a*, 59*b*, 60*a* and 60*b* set up on a cart 58 so as to form zigzag inclined passages. Curved surfaces 62*a*, 63*a* and 64*a* for reversing the rolling direction of the package are formed in the guide plates 62, 63 and 64. Packages Pr roll on the guide plates 61 to 64 as indicated by an arrow 65. A first package P1 is stopped by a stopping plate 66 provided at the extremity of the bottom guide plate 64. Then, the successive packages P2, P3, . . . and Pn are stored one after the other in the stocker.

In this embodiment, the stocker is designed to store packages in four rows. As illustrated in FIG. 6, partition pipes 67 to 71 are fixed to the guide plates 61 to 63 to guide the packages for regular rolling along the guide plates. The partition pipes 67 to 71 serves also as structural members of the stocker and prevent the bending of the guide plates. Reference characters 72 and 73 designate guide rods for guiding the packages P which roll along the opposite side passages on the top guide plate 61 so that the packages P will roll down correctly along the passages without falling off from the cart.

Wheels 74 are attached to the bottom frame of the cart 58. The cart 58 is moved to a position beside the package conveyor 2 by the operator. Guide bars 75 are provided on the frame 8 (FIG. 2) to guide the cart 58 to a correct position relative to the package conveyor 2. The cart 58 is moved toward the package conveyor 2 as far as the front wheels 74 come into abutment with a stopper 76, where the top guide plate 61 of the cart 58 is located under the inclined guide plate 24 and the package passages B1 to B4 of the stocker 7 are aligned with the package transferring positions A1 to A4, respectively, as shown in FIG. 6.

A photoelectric sensor consisting of devices 77 and 78 is provided to confirm the arrival of the stocker 7 at the correct position relative to the package conveyor 2 and the package transferring mechanism 6. The package conveyor and the package transferring mechanism remain inoperative before the arrival of the stocker at the correct position is detected. A photoelectric sensor consisting of devices 79 and 80 shown in FIG. 6 is a safety sensor for stopping the operation of the package conveyor 2 and the associated mechanism, and the package conveyor of the automatic winder, when a package pushed off the package conveyor 2 stays on the guide plate 24. A control circuit is accomodated in a box 81 shown in FIG. 1.

The functions of the above-mentioned package storage system will be described hereinafter.

After placing an empty stocker 7 at the fixed position as shown in FIG. 1, the main switch of the package storage system is turned on. Then, the package conveyor 82 of the winder and the package conveyor 2 of the package storage system start turning. Full packages P doffed from the winder are conveyed in a direction indicated by an arrow 83 in FIG. 2 at irregular intervals and are transferred from the package conveyor 82 to the package conveyor 2. The packages P are conveyed in a correct position with the center axes thereof in parallel to the conveying direction and with the surfaces thereof held between the round belts 4*a* and 4*b* as shown in FIG. 3.

Figure 7C:
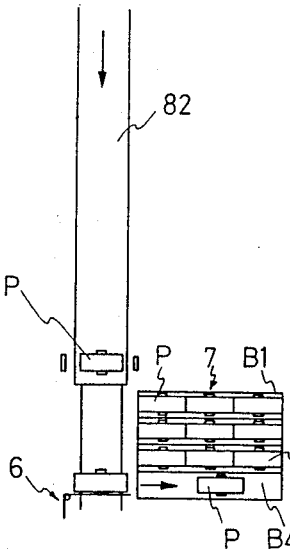
Figure 7B:
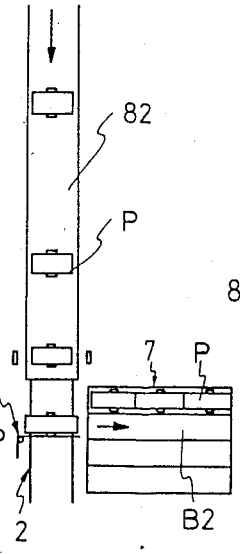
Figure 7A:
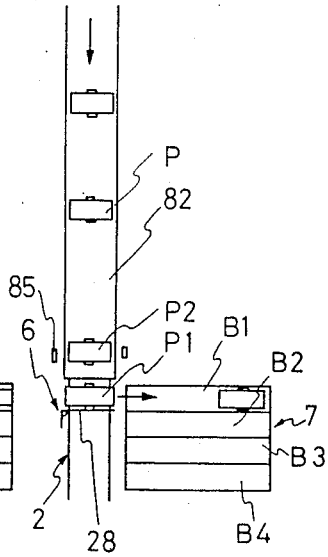

In delivering the packages to an empty stocker, first the package positioning mechanism 6 is located previously, for example, at a position corresponding to the package passage B1 of the stocker 7 as shown in FIG. 7*a*. The package P1 thus conveyed by the package conveyor 2 pushes the sensing plate 28. Consequently, the sensing plate 28 is caused to swing against the resilient force of the spring 43 from the position indicated by continuous lines to the position 28*a* indicated by alternate long and two short dashes lines as illustrated in FIG. 4 until the stopper 84 thereof comes into abutment with the supporting member 26. In this state, the package P1 is stopped and located correctly at the package transferring position corresponding to the package passage B1 of the stocker 7. When the sensing plate 28 is turned, the dog 41 (FIG. 4) pushes the feeler 45*a*, then the feeler 45*a* turns the rod 46 (FIG. 3) and then the actuating arm 49 actuates the proximity switch 50. Then, the hydraulic cylinder 20 is actuated to retract the piston rod 23, thereby all the pushing plates 5*a* to 5*d* are caused to swing from the position indicated by continuous lines to the position indicated by alternate long and two short dashes lines 5Z. Thus, the pushing plate 5*a* corresponding to the package P1 pushes the package P1 from below to transfer the package P1 across the round belt an 4*a* to the stocker. Then, the package P1 rolls down along the inclined guide plates 61 to 64 to the bottom of the stocker as illustrated in FIG. 1. Thus, one cycle of operation for storing one package is completed. It is possible to control the operation of the hydraulic cylinder 20 by a timer or the like so as to return the hydraulic cylinder 20 to the original position thereof immediately after the package has been pushed out from the package conveyor or to control the hydraulic cylinder 20 in accordance with the condition of the proximity switch 50 which is turned off when the sensing plate 28*a* (FIG. 4) returns to the original position after the package has been delivered to the stocker.

As illustrated in FIG. 7*a*, packages are stored one after another in the package passage B1 of the stocker 7. Upon the detection of the arrival of the succeeding package P2 at the position shown in FIG. 7*a* by the sensor 85 after the preceding package P1 has been transferred from the package conveyor of the winder to the package conveyor of the package storage system and the passage of the package P1 has been detected by the sensor 56, the package conveyor 82 is stopped to keep the package P2 waiting on the package conveyor 82 for transfer to the package conveyor 2.

When the storage of a preselected number of the packages in the package passage B1 is detected, for example, by counting the number of repetition of the ON-OFF operation of the proximity switch 50 which is controlled by the package sensing plate 28, a driving signal is given to the motor 37 for driving the chain. As the chain is driven, the supporting member 26 (FIG. 3) moves along the package conveyor 2. Upon the detection of the bottom plate 26*a* by the proximity switch 54*b* (FIG. 6), the motor 37 is stopped, and thereby the package positioning mechanism 6 is located at a position corresponding to the package passage B2 next to the package passage B1 as illustrated in FIG. 7*b*. Simultaneously with the interruption of the operation of the motor 37, the package conveyor 82 of the winder and the package conveyor 2 of the package storage system are restarted to store the packages in the package passage B2 in the same manner as that described hereinbefore.

In a state as illustrated in FIG. 7*c*, where all the package passages B1 to B4 are filled with the packages P, the completion of loading the stocker 7 with the packages is notified by a buzzer or a flicker signal. Then, the full stocker 7 is replaced with an empty stocker.

In this embodiment, the packages are transferred from the package conveyor 2 to the stocker one by one. However, it is also possible to eliminate the package positioning mechanism 6 (FIG. 6) and to actuate all the pushing plates 5*a* to 5*d* simultaneously when four packages are arranged at regular intervals opposite to the package passages B1 to B4, respectively, to transfer the four packages simultaneously from the package conveyor 2 to the stocker. In such a case, package stoppers capable of projecting into and retracting from the package conveyor are disposed so as to correspond to the pushing plates, respectively, and the pushing plates are actuated upon the detection of a package by the package stopper corresponding to the package passage B1.

In this embodiment, a stocker 7 of the handcart type is employed, however, further automatic doffing and transportation of the packages is possible by using the place occupied by the stocker 7 (FIG. 1) as a package packing station where the packages are packed in a box instead of storing in the wheeled stocker and by handling the boxes by an unmanned cart.

What is claimed is:

1. A package storage system comprising: a package conveyor for conveying packages doffed from a winder; a stocker disposed nearby said package conveyor; and a package transferring mechanism for transferring the packages from said package conveyor to said stocker, wherein said package transferring mechanism includes a package positioning device which is movable along the package conveyor for positioning the package conveyed by the package conveyor at a transfer position and a package transferring device for transferring the package positioned at the transfer position to the stocker, and wherein said package positioning device includes a package sensing member and means for detecting the arrival of the package at the transfer position.

2. A package storage system as claimed in claim 1, wherein said package conveyor is disposed at a fixed position relative to the winder and comprises two parallel round belts spaced apart from each other by a fixed distance.

3. A package storage system as claimed in claim 1, wherein said stocker comprises a plurality of guide plates fixed to posts to form zigzag inclined passages, curved surfaces for reversing the rolling direction of the package being formed at one end of said guide plate and a stopping plate being provided at the extremity of a bottom guide plate.

4. A package storage system as claimed in claim 3, wherein a fixed guide plate is formed on the transfer side of the package conveyor to guide packages to the guide plates of the stocker, partition members for defining the package passages being fixed at regular intervals of the upper surface of said fixed guide plate, and partition pipes are fixed to the guide plates of the stocker at corresponding positions to said partition members.

5. A package storage system as claimed in claim 1, wherein said package transferring device comprises individual pushing plates fixed to a shaft extending along the package conveyor at positions corresponding to package transfer positions, respectively, and a driving source to turn the shaft so that the pushing plates are swingable between a waiting position and transfer position.

6. A package storage system comprising: a package conveyor for conveying packages doffed fron a winder; a stocker disposed adjacent said package conveyor; and a package transferring mechanism for transferring the packages from said package conveyor to said stocker, wherein said package transferring mechanism includes a package positioning device which is movable along the package conveyor for positioning the package conveyed by the package conveyor at a transfer position and a package transferring device for transferring the package positioned at the transfer position to the stocker, and wherein said package positioning device includes a supporting member capable of moving along the package conveyor, a package sensing member joined to the supporting member with a hinge so as to be swingable on the supporting member, and means for detecting the arrival of the package at the transfer position.

7. A package storage system as claimed in claim 6, wherein said supporting member is formed by integrally joining together a bottom plate and a vertical plate having a flat surface extending substantially perpendicularly to the package conveying direction, and further including a slider and a roller which are fixed at the lower surface of the bottom plate, said slider being supported on a slide shaft extemded in parallel to the package conveyor and being connected to a driving means.

8. A package storage system as claimed in claim 6, wherein said package sensing member is a substantially L-shaped plate having a package pushing surface and a supporting surface which supports a package sensing dog, and further including a spring extended between the supporting surface and the supporting member.

9. A package storage system as claimed in claim 8, wherein a plurality of feelers which are actuated by the dog of the package sending member are fixed to a rod extended in parallel to the package conveyor so that each of said feelers corresponds respectively to one of the package transferring positions.

* * * * *